United States Patent [19]

Ohsumi

[11] Patent Number: 5,017,163

[45] Date of Patent: May 21, 1991

[54] TERMINAL ENGAGING APPARATUS OF CONNECTOR

[75] Inventor: Hideki Ohsumi, Shizuoka, Japan

[73] Assignee: Yazaki Corporation, Tokyo, Japan

[21] Appl. No.: 556,475

[22] Filed: Jul. 24, 1990

[30] Foreign Application Priority Data

Aug. 2, 1989 [JP] Japan ..... 1-90416[U]
Nov. 21, 1989 [JP] Japan ..... 1-134538[U]

[51] Int. Cl.[5] ..... H01R 13/436
[52] U.S. Cl. ..... 439/752
[58] Field of Search ..... 439/752, 595, 733

[56] References Cited

U.S. PATENT DOCUMENTS 4,932,899 6/1990 Sueyoshi et al. ..... 439/595
4,946,398 8/1990 Takenouchi et al. ..... 439/752

FOREIGN PATENT DOCUMENTS 2909614 9/1980 Fed. Rep. of Germany ..... 439/752
59-228380 12/1984 Japan .

*Primary Examiner*—Gary F. Paumen

*Attorney, Agent, or Firm*—Venable, Baetjer, Howard & Civiletti

[57] ABSTRACT

A terminal engaging apparatus of a connector comprises a connector housing having a chamber, formed in a rear portion thereof and surrounded by a peripheral wall, and a terminal engaging member having an E-shape configuration. The terminal engaging member is adapted to engage the chamber. The terminal engaging member comprises a base side member, opposite side members, and an intermediate member. The side members and intermediate member are integrally formed with the base side member. The base side member can be engaged with or disengaged from the connector housing. The opposite side members have engaging projections on their free ends. The intermediate member has an engaging projection at its leading end. The connector housing has engaging holes formed in its peripheral wall and adapted to be engaged with the projections on the side members and the intermediate member. Tapered driving portions are formed on the peripheral wall and adapted to be urged against the free ends of the side members so as to flex the latter.

7 Claims, 5 Drawing Sheets

TERMINAL ENGAGING APPARATUS OF CONNECTOR

BACKGROUND OF THE INVENTION

1. Field of the Invention

This invention relates to a terminal engaging apparatus of a connector for use with electrical wirings of motor vehicles, etc.

2. Description of the Prior Art

As shown in FIGS. 10 and 11, a connector housing A made of a synthetic resin and formed with a plurality of terminal accommodation chambers "a" has a chamber "b" formed in the rear end portion of the connector housing. The chamber "b" is adapted to accommodate a frame-shaped terminal engaging means B. The terminal engaging means B is adapted to be detachably engaged with the accommodation chamber "b".

The terminal engaging means B is made of a synthetic resin like the connector housing A and is molded in the form of an E-shaped frame comprising a base side member c, two opposite outer side members d, d, and an intermediate member e. The outer side members d, d and the intermediate member e are integrally connected to the base side member c. The two opposite side members d, d and the intermediate member e have two grooves f, f defined therebetween for inserting electrical wirings D, D having terminal metal fixtures C, C connected therewith. The arrangement is made such that the edges of the opposite side members d, d facing the insertion grooves f, f and the edges of the intermediate member e engage the rear end portions of the terminal metal fixtures C, C so as to prevent the terminal metal fixtures from slipping out of position.

The opposite side members d, d have flexible locking pieces g, g formed integrally on the outer surfaces thereof. When the terminal engaging means B is inserted in the accommodation chamber b, engaging projections h, h of the locking pieces g, g engage engaging holes i, i formed in the connector housing A. This prior art is disclosed in Japanese Laid-Open Patent application No. SHO. 59-228380.

The above-mentioned prior art example is disadvantageous in that the terminal engaging means B engages the connector housing A by means of the two flexible locking pieces g, g so that in order to remove the terminal engaging means B from the connector housing A, two operations are needed to unlock both of the locking pieces g, g one by one, thus making it troublesome to remove the terminal engaging means from the connector housing.

SUMMARY OF THE INVENTION

The present invention has been made in view of the above-mentioned circumstances in the prior art. Accordingly, an object of the invention is to provide a terminal engaging apparatus of a connector, wherein in the case of the terminal engaging means having a plurality of locking pieces, the terminal engaging means can be readily disengaged from the connector housing by only one operation.

According to one aspect of the present invention, there is provided a terminal engaging apparatus of a connector, comprising a connector housing having a rearwardly open accommodation chamber, formed in the rear end portion thereof and surrounded by a peripheral wall, and a terminal engaging means of a frame configuration adapted to be detachably engaged with the accommodation chamber. The terminal engaging means comprises a base side member, at least one leg member, and an intermediate member. The at least one leg member and intermediate member are integrally connected to the base side member. The base side member is arranged such that it may be engaged with or disengaged from the connector housing. The leg members have engaging projections formed integrally on the outer surfaces of the free end portions thereof, and the intermediate member has an engaging projection formed integrally at the leading end thereof. The connector housing has engaging holes formed in the peripheral was thereof. The engaging holes are adapted to be engaged with the engaging projections, respectively. The connector housing further has tapered driving portions formed on the inner surface of the peripheral wall, that are adapted to be brought into contact with the free end portions of the leg members so as to flex the free end portions.

Further, engagement and disengagement of the base side member of the terminal engaging means with and from the connector housing are made by means of a projection formed integrally on the outer surface of the base side member and an engaging hole formed in the peripheral wall of the connector housing.

Further, engagement and disengagement of the base side member of the terminal engaging means with and from the connector housing are made by means of the base side member body and covering pieces formed integrally on the peripheral wall of the connector so as to project inwardly therefrom.

Still further, each of the free end portions of the leg members of the terminal means is partially divided by a groove into two parts so as to form a flexible portion. Each of the flexible portions has an engaging projection formed integrally on the outer surface thereof.

Further, according to another aspect of the present invention, there is provided a terminal engaging apparatus of a connector, comprising a connector housing having a rearwardly open accommodation chamber formed in the rear end portion thereof and surrounded by a peripheral wall, and a terminal engaging means of a U-shaped frame configuration adapted to be detachably engaged with the accommodation chamber. The terminal engaging means further comprises a base side member and at least one flexible leg member connected integrally thereto. The base side member has an engaging projection formed integrally on the outer surface thereof. The leg members have engaging projections formed integrally on the outer surfaces of the intermediate portions thereof and engaging projections formed at the leading ends thereof. The connector housing has engaging holes formed in the peripheral wall thereof. The engaging holes are adapted to be engaged with the engaging projections. The connector housing further has tapered driving portions formed in the engaging holes thereof, that are adapted to be brought into contact with the engaging projections formed on the outer surfaces of the intermediate portions of the leg members so as to flex the side members.

Still further, the opposite side members of the terminal engaging means are thin-walled so that they may be readily flexed.

Yet further, the free ends of the leg members of the terminal engaging means are connected integrally by a connecting member.

The terminal engaging apparatus of a connector, according to the present invention, having the above-mentioned configuration effectively provides a terminal engaging means having a plurality of engaging projections that can be disengaged from the connector housing by a simple operation.

DESCRIPTION OF THE PREFERRED EMBODIMENTS

Figure 1:
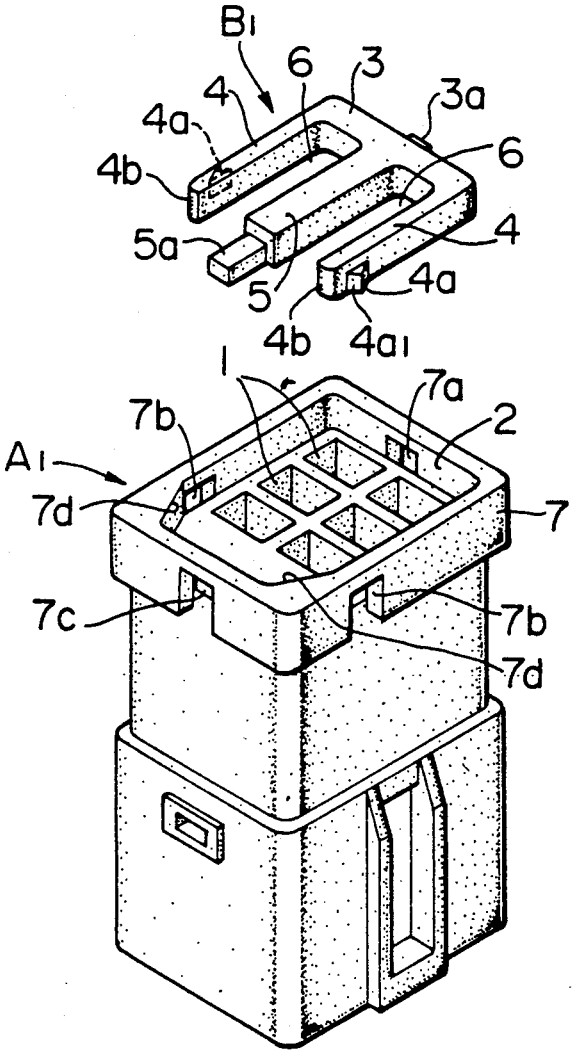
FIG. 1 is a perspective view of a connector housing and a terminal engaging means of one embodiment of the present invention in separated condition.

FIG. 1 shows a first embodiment of the present invention, wherein reference character $A_1$ denotes a connector housing, made of a synthetic resin, having a plurality of terminal accommodating chambers and a chamber 2 formed in the rear end portion thereof so as to accommodate a frame-shaped terminal engaging means $B_1$. The chamber 2, for accommodating the terminal engaging means $B_1$, is open rearwardly so that the terminal engaging means $B_1$ may be mounted therein and dismounted therefrom in the rear thereof.

The terminal engaging means $B_1$ is made of a synthetic resin and has a frame configuration, consisting of one or more leg members 4, 4 and an intermediate member 5, which are connected integrally to a base side member 3 on one side thereof. The leg members 4, 4 and the intermediate member 5 have two grooves 6, 6 defined therebetween, in which are inserted electrical wires (not shown) having terminal metal fixtures connected therewith (not shown). As mentioned hereinabove, the edges of the leg members 4, 4 and those of the intermediate member 5 facing the insertion grooves 6, 6 are adapted to be engaged with the rear ends of the terminal metal fixtures to prevent the metal fixtures from slipping out of position.

The free end portions of the flexible one or more leg members 4, 4 have engaging projections 4*a*, 4*a*, respectively, formed on the outer surfaces thereof. Each of the projections has a tapered driven surface 4*a*. Further, the free end of the intermediate portion 5 and the intermediate portion of the base side member 3 have engaging projections 3*a* and 5*a*, respectively, formed integrally therewith. The above-mentioned chamber 2 in the connector housing $A_1$ has engaging holes 7*a*, 7*b* and 7*c* formed in the peripheral wall 7 thereof so as to fit the engaging projections 3*a*, 4*a* and 5*a*, respectively. The peripheral wall 7 has tapered driving portions 7*d*, 7*d*, respectively, formed in the corners thereof adjacent to the two engaging holes 7*b*, 7*b* formed in the peripheral wall 7 at opposite positions so as to correspond to the engaging projections 4*a*, 4*a*, respectively.

Figure 2A:
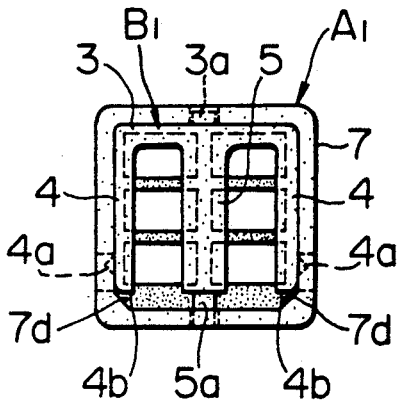
FIG. 2A is a plan view of the FIG. 1 embodiment of the present invention showing a condition wherein the terminal engaging means is engaged with the connector housing.
Figure 3A:
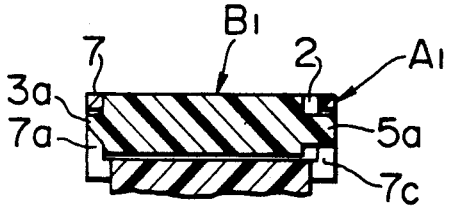
FIGS. 3A, 3B and 3C are sectional views, respectively, showing successive steps of removing the terminal engaging means from the connector housing.

In the above-mentioned arrangement, the terminal engaging means $B_1$ is accommodated in the chamber 2 of the connector housing $A_1$ such that the engaging projections 3*a*, 4*a* and 5*a* are kept in engagement with the holes 7*a*, 7*b* and 7*c*, respectively, in the peripheral wall 7, and the free end portions 4*b*, 4*b* of the leg members 4, 4 are located adjacent to the tapered driving portions 7*d*, 7*d*. (see FIGS. 2A and 3A)

Figure 2B:
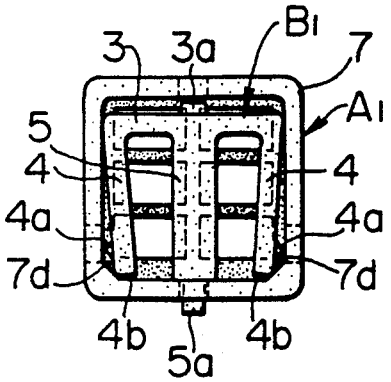
FIG. 2B is a plan view showing a condition wherein the terminal engaging means has been moved to remove it from the connector housing.
Figure 3B:
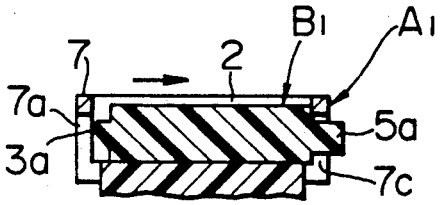
Figure 3C:
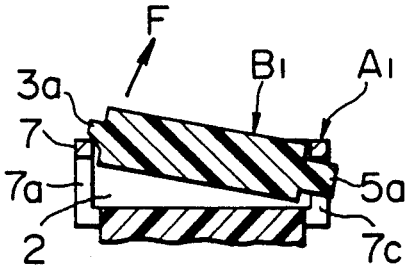

To remove the terminal engaging means $B_1$ from the connector housing $A_1$, it is only necessary to push the terminal engaging means $B_1$ towards the free end portions of the E-shaped frame thereof by means of a jig so that the free end portions 4*b*, 4*b* of the leg members 4, 4 may be flexed inwardly by the tapered driving portions 7*d*, 7*d* so as to disengage and move the engaging projections 4*a*, 4*a* from the engaging holes 7*b*, 7*b*, respectively, (see FIGS. 2B and 3B) and then move the base side member 3 in this condition, outwardly as shown by arrow F to remove the terminal engaging means therefrom (see FIG. 3C).

Figure 4:
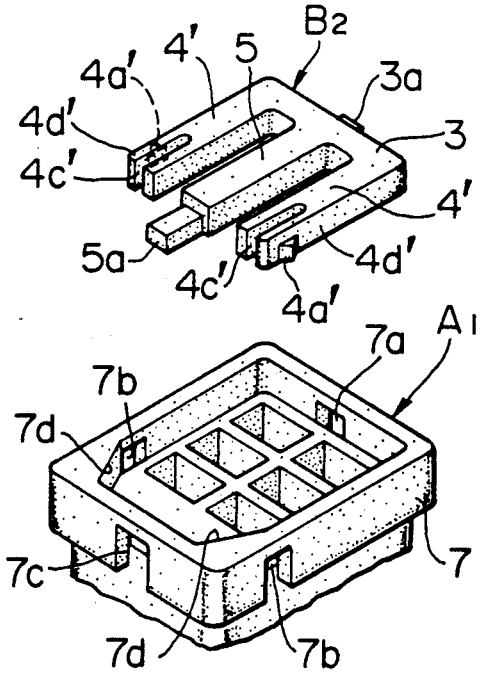
FIGS. 4 and 5 are perspective views showing connector housings and terminal engaging means of other embodiments according to the present invention in separated condition.

FIG. 4 shows another embodiment of the present invention. In this embodiment, the connector housing $A_1$ is identical in construction to that shown in FIG. 1. The terminal engaging means $B_2$ has thicker opposite side members 4', 4'. The free end portions of the side members 4', 4' have flexible portions 4*d'*, 4*d'*, respectively, each having a groove 4*c'* formed therein. Each of the flexible portions 4*d'*, 4*d'* has an engaging projection 4*a'* formed integrally on the outer surface thereof.

Figure 5:
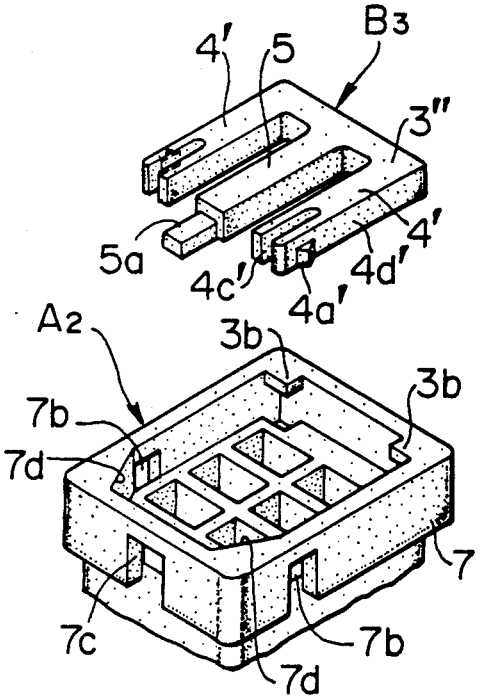

In a further embodiment of the present invention shown in FIG. 5, terminal engaging means $B_3$ has a base side portion 3'' without an engaging projection, while connector housing $A_2$ has covering pieces 3*b*, 3*b* formed inside the peripheral wall 7 and adapted to restrain the base side member 3.

Figure 6:
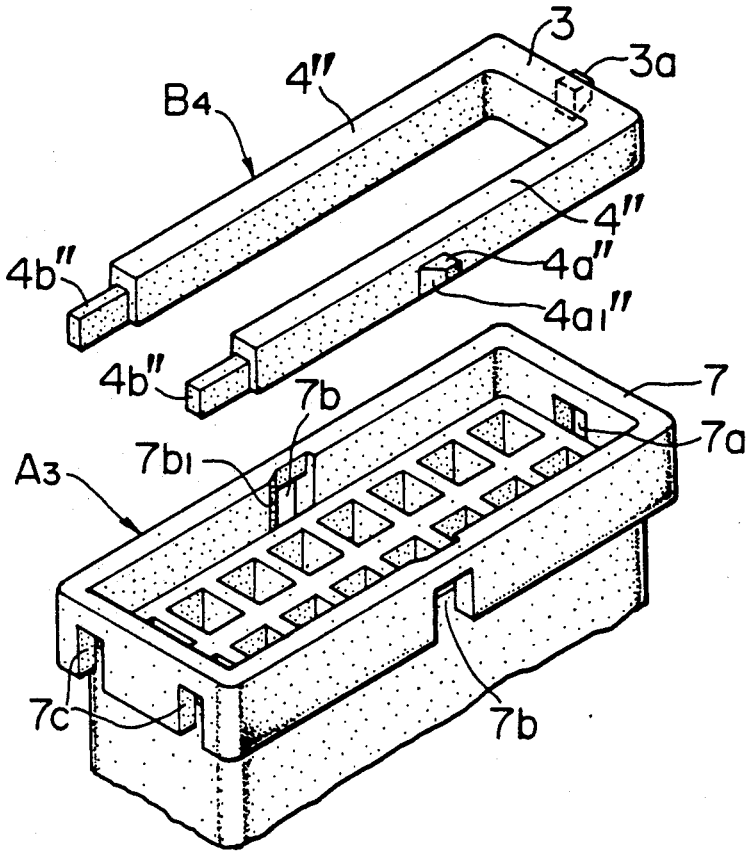
FIG. 6 is a perspective view showing a connector housing and a terminal engaging means of a further embodiment according to the present invention in separated condition.

In a still further embodiment shown in FIG. 6, terminal engaging means $B_4$ is of a frame configuration consisting only of a base side member 3 and one or more leg members 4", 4". The flexible leg members 4", 4" have engaging projections 4a", 4a" respectively, formed integrally on the intermediate portions thereof, each having a tapered driven surface $4a_1$". The leg members 4", 4" also have engaging projections 4b", 4b", respectively, formed in the free ends thereof as their extensions. The connector housing $A_3$ has engaging holes 7b, 7b, respectively, formed in the peripheral wall 7 so as to correspond to the above-mentioned engaging projections 4a", 4a", respectively. Each of the holes 7b, 7b has a tapered driving portion $7b_1$. Further, the peripheral wall 7 has engaging holes 7c, 7c formed therein so as to correspond to the engaging projections 4b", 4b", respectively.

Figure 7A:
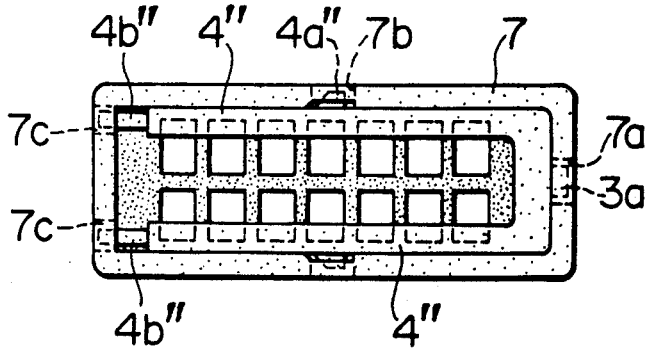
FIG. 7A is a plan view showing a condition wherein the terminal engaging means is engaged with the connector housing.
Figure 7B:
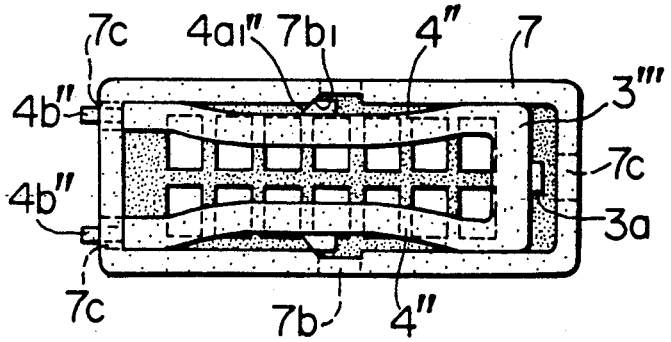
FIG. 7B is a plan view showing a condition wherein the terminal engaging means has been moved or flexed so as to remove it from the connector housing.

In the above-mentioned configuration, if the terminal engaging means $B_4$ is pushed by means of a jig towards the free end portions of the frame thereof from the condition wherein it is mounted in the connector housing $A_3$ as shown in FIG. 7A, then the engaging projections 4a", 4a" are driven through the tapered driven surfaces $4a_1$", $4a_1$" by the tapered driving portions $7b_1$, $7b_1$ formed in the engaging holes 7b, 7b, respectively, so that the engaging projections 4a" may be disengaged from the engaging holes 7b, 7b, respectively. Meanwhile the intermediate portions of the leg members 4", 4" are allowed to be flexibly displaced such that the U-shaped frame of the terminal engaging means (see FIG. 7B) is moved thereby enabling the terminal engaging means $B_4$ to be removed from the connector housing $A_3$ in the same manner as mentioned hereinabove.

Figure 8A:
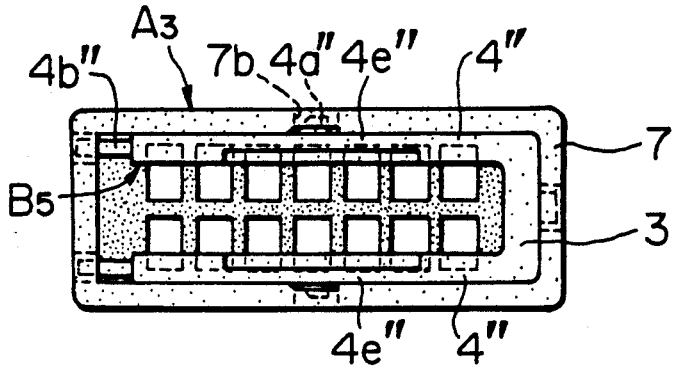
FIG. 8A is a plan view showing a condition wherein a terminal engaging means is engaged with a connector housing in a still further embodiment of the present invention.
Figure 8B:
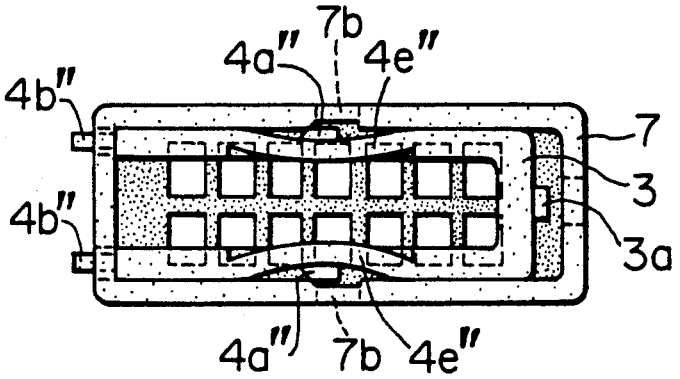
FIG. 8B is a plan view showing a condition wherein the terminal engaging means has been moved or flexed so as to remove it from the connector housing in the embodiment shown in FIG. 8A.

In yet further embodiments shown in FIGS. 8A and 8B, terminal engaging means B3 comprises one or more leg members 4", 4" having flexible thin walled portions 4e", 4e" formed in the intermediate region thereof so as to permit their flexural deformation. The flexible thin walled portions 4e", 4e" have the aforementioned engaging projections 4a", 4a", respectively, formed integrally on the outer surfaces thereof.

Figure 9A:
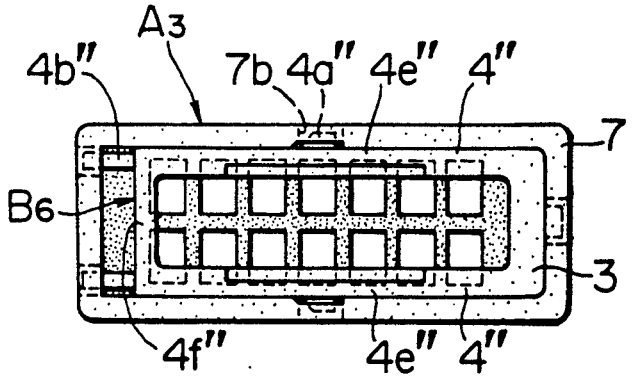
FIG. 9A is a plan view showing a condition wherein a terminal engaging means is engaged with a connector housing in yet a further embodiment of the present invention.
Figure 9B:
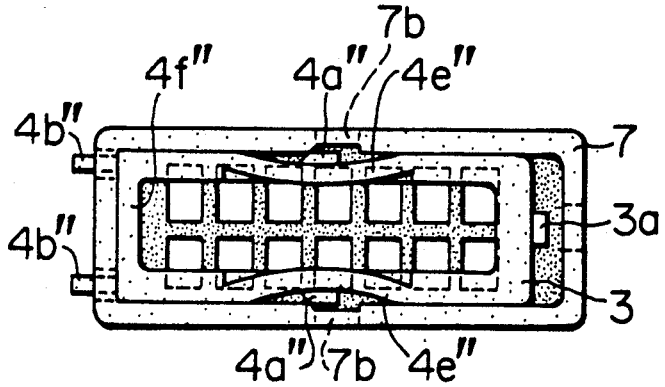
FIG. 9B is a plan view showing a condition wherein the terminal engaging means has been moved or flexed so as to remove it from the connector housing in the embodiment shown in FIG. 9A.
Figure 10:
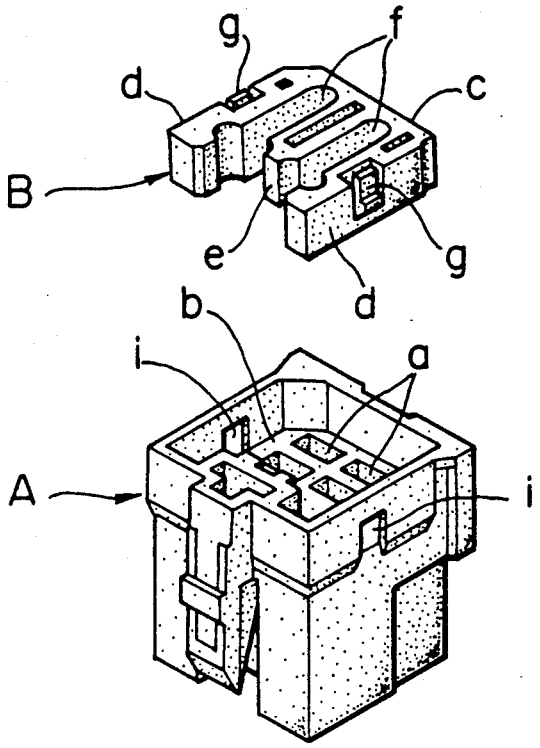
FIG. 10 PRIOR ART
Fig. 10 is a perspective view showing a condition wherein a terminal engaging means is separated from a connector housing in a prior art example.
Figure 11:
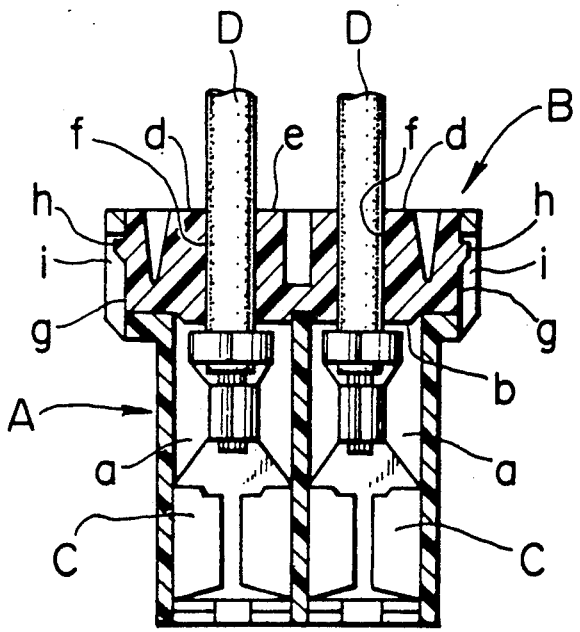
FIG. 11 PRIOR ART
FIG. 11 is a sectional view of the prior art example of FIG. 10, showing a condition wherein the terminal engaging means is engaged with the connector housing.

In further embodiments shown in FIGS. 9A and 9B, terminal engaging means $B_6$ is of a rectangular, hollow frame configuration wherein the aforementioned free end portions of the leg members 4", 4" are connected integrally by a connecting member 4f".

In each of the above-mentioned embodiments, the engaging projections are formed on the terminal engaging means and the engaging holes are formed in the connector housing, however, the engaging projections may be formed on the connector housing, and the engaging holes may be formed in the terminal engaging means.

While there have been shown and described preferred embodiments of the present invention, it will be obvious to those skilled in the art that various changes and modifications may be made therein without departing from the invention and, therefore, it is intended that the appended claims cover all such changes and modifications as fall within the true spirit and scope of the invention.

What is claimed is:

1. A terminal engaging apparatus of a connector, comprising a connector housing having a rearwardly opening accommodation chamber formed in the rear end portion thereof and surrounded by a peripheral wall, and a terminal engaging means having a frame-shaped configuration adapted to be detachably engaged with the accommodation chamber, said terminal engaging means comprising a base side member, at least one leg member, and an intermediate member having a leading end, said at least one leg member and said intermediate member both being connected integrally to the base side member;

wherein said base side member is arranged to be engaged with or disengaged from said connector housing;

wherein said at least one leg member has an engaging projection formed integrally on the outer surface of a free end portion thereof, and said intermediate member has an engaging projection formed integrally at the leading end thereof;

wherein said connector housing has engaging holes formed in the peripheral wall thereof for engaging said engaging projections; and wherein said connector housing further has at least one tapered driving portion formed on the inner surface of the peripheral wall, said at least one tapered driving portion being adapted to be brought into contact with the free end portion of said at least one leg member during removal of said terminal engaging means from said accommodation chamber so as to initiate flexing of the free end portion to allow disengagement of said engaging projections from said engaging holes.

2. A terminal engaging apparatus of a connector according to claim 1, wherein the base side member of said terminal engaging means engages with or disengages from said connector housing by means of a projection formed integrally on the outer surface of said base side member and a complementary engaging hole formed in the peripheral wall of said connector housing.

3. A terminal engaging apparatus of a connector according to claim 1, wherein the base side member of said terminal engaging means engages with or disengages from said connector housing by means of the body of said base side member and covering pieces formed integrally on the peripheral wall of said connector housing so as to project inwardly therefrom.

4. A terminal engaging apparatus of a connector according to claim 1, wherein the free end portion of the at least one leg member of said terminal engaging means is partially divided by a groove into two parts so as to form a flexible portion, said flexible portion having a said engaging projection formed integrally on the outer surface thereof.

5. A terminal engaging apparatus of a connector, comprising a connector housing having a rearwardly opening accommodation chamber formed in the rear end portion thereof and surrounded by a peripheral wall, and a terminal engaging means having a frame-shaped configuration adapted to be detachably engaged means comprising a base side member and at least one flexible leg member connected integrally thereto;

wherein said base side member has an engaging projection formed integrally on an outer surface thereof, and said at least one leg member has an engaging projection formed integrally on an outer surface of an intermediate portion thereof and an engaging projection formed integrally at a leading end thereof;

wherein said connector housing has engaging holes formed in the peripheral wall thereof, that are adapted to engage said engaging projections; and wherein said connector housing further has at least one tapered driving portion formed in at least one said engaging hole, said at least one tapered driving portion being adapted to be brought into contact with the engaging projection formed on the outer surface of the intermediate portion of said at least one leg member during removal of said terminal engaging means from said accommodation chamber so as to flex the at least one leg member and allow disengagement of said engaging projections from said engaging holes.

6. A terminal engaging apparatus of a connector according to claim 5, comprising two opposing leg members of said terminal engaging means, said leg members being thin-walled so as to be readily flexed.

7. A terminal engaging apparatus of a connector according to claim 5, comprising two opposing leg members of said terminal engaging means that are connected integrally by a connecting member.

* * * * *